US011282628B2

(12) United States Patent
Ishimori et al.

(10) Patent No.: US 11,282,628 B2
(45) Date of Patent: Mar. 22, 2022

(54) REACTOR FOR VEHICLE

(71) Applicant: Mitsubishi Electric Corporation, Tokyo (JP)

(72) Inventors: Yuki Ishimori, Tokyo (JP); Tetsuya Sakurada, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 208 days.

(21) Appl. No.: 16/623,439

(22) PCT Filed: Jul. 6, 2017

(86) PCT No.: PCT/JP2017/024847
§ 371 (c)(1),
(2) Date: Dec. 17, 2019

(87) PCT Pub. No.: WO2019/008731
PCT Pub. Date: Jan. 10, 2019

(65) Prior Publication Data
US 2020/0211757 A1 Jul. 2, 2020

(51) Int. Cl.
*H01F 27/06* (2006.01)
*H01F 27/08* (2006.01)
(Continued)

(52) U.S. Cl.
CPC ..... *H01F 27/266* (2013.01); *H01F 27/06* (2013.01); *H01F 27/08* (2013.01); *H01F 27/30* (2013.01);
(Continued)

(58) Field of Classification Search
CPC ..... H01F 27/266; H01F 27/30; H01F 27/06; H01F 27/08; H01F 30/16; H01F 37/00; H01F 27/085; H01F 27/303; H01F 37/005
See application file for complete search history.

(56) References Cited

U.S. PATENT DOCUMENTS 1,396,563 A * 11/1921 Faccioli ..... H01F 27/2871 336/183
2,901,717 A * 8/1959 Storsand ..... H01F 37/005 336/223
(Continued)

FOREIGN PATENT DOCUMENTS

| | | | |
|---|---|---|---|
| JP | H04317308 | A | 11/1992 |
| WO | 2008093492 | A1 | 8/2008 |
| WO | 2012090258 | A1 | 7/2012 |

OTHER PUBLICATIONS

International Search Report (PCT/ISA/210) dated Sep. 26, 2017, by the Japan Patent Office as the International Searching Authority for International Application No. PCT/JP2017/024847.

*Primary Examiner* — Tuyen T Nguyen
(74) *Attorney, Agent, or Firm* — Buchanan Ingersoll & Rooney PC

(57) ABSTRACT

A coil includes unit coils wound around a central axis and adjacent to each other with a space therebetween in a central axis direction. A reactor includes a pair of support frames and one or more spacers, the support frames facing each other in the central axis direction across the coil. The spacers are disposed between adjacent unit coils or between the support frame and the coil. At least one of the spacers is a variable spacer that includes a first member and a second member, the first member having one end face which has a recess, and the second member including a fitting portion to be fitted into the recess of the first member in the central axis direction. The linear expansion coefficient of the second member is less than the linear expansion coefficient of the first member.

20 Claims, 22 Drawing Sheets

(51) Int. Cl.

| | |
|---|---|
| ***H01F 27/26*** | (2006.01) |
| ***H01F 30/16*** | (2006.01) |
| ***H01F 37/00*** | (2006.01) |
| ***H01F 27/30*** | (2006.01) |

(52) U.S. Cl.
CPC ..... *H01F 27/303* (2013.01); *H01F 30/16* (2013.01); *H01F 37/00* (2013.01)

(56) References Cited

U.S. PATENT DOCUMENTS

| | | | | |
|---|---|---|---|---|
| 3,621,429 | A * | 11/1971 | Benke ..... | H01F 37/005<br>336/197 |
| 2010/0026434 | A1 | 2/2010 | Okamoto et al. | |
| 2013/0039815 | A1 | 2/2013 | Murata | |

* cited by examiner

REACTOR FOR VEHICLE

TECHNICAL FIELD

The present disclosure relates to a reactor for vehicle installed in a railroad vehicle.

BACKGROUND ART

A reactor is installed in an electric railroad vehicle for the purpose of inhibiting an abrupt change in an electric current flowing in a main circuit. When running on a railroad, a railroad vehicle vibrates more significantly than automobiles. To reduce a load on a coil caused by vibrations of the running railroad vehicle, the coil in a reactor is insulated and fixed to a support frame. The support frame holding the coil is attached to a vehicle body.

In an air-core self-cooling reactor disclosed in Patent Literature 1, a spacer is inserted between disc-shaped coils and the coils are fixed by fastening studs to the coil support frames disposed at both ends of the reactor.

CITATION LIST

Patent Literature

Patent Literature 1: Unexamined Japanese Patent Application Kokai Publication No. H04-317308

SUMMARY OF INVENTION

Technical Problem

To reduce a loss in the coil during energization, materials such as aluminum or copper are used for the coil. On the other hand, concerning the support frame, the bolt securing the coil to the support frame and the like, ferrous materials such as carbon steel are used in view of factors including material cost, ease of machining, or the like. In this case, the material of the coil is different from the material of the support frame and the bolt, and thus the linear expansion coefficient of the coil is different from the linear expansion coefficients of the support frame and the bolt.

In the air-core self-cooling reactor disclosed in Patent Literature 1, a load caused by vibrations of a running railroad vehicle is not imposed on the coil because the coil is fixed to the support frame. However, when, for example, the coil is energized and the temperature of the coil rises, a thermal stress is caused depending on a difference in expansion between the coil and the support frame, the difference arising from a difference in heat expansion coefficient between the coil and the support frame. In case where the coil is fixed to the support frame as in the air-core self-cooling reactor disclosed in Patent Literature 1, a compression force caused by a thermal stress is applied to the coil. A greater compression force may create a load imposed on an insulated portion of the coil to reduce the reliability for long-term use.

The present disclosure is made in view of the foregoing circumstances, and an objective of the disclosure is to reduce a load on the coil due to vibrations of a running railroad vehicle and due to a thermal stress.

Solution to Problem

To achieve the aforementioned objective, a reactor for vehicle of the present disclosure includes a coil, a pair of support frames, one or more spacers, bolts, and fastening members. The coil includes unit coils that are wound around the central axis and the unit coils are adjacent to each other with a space therebetween in a central axis direction that is a direction of the central axis. The pair of support frames faces each other in the central axis direction with the coil sandwiched between the pair of support frames. The one or more spacers are each disposed between the unit coils adjacent to each other in the central axis direction or between each of the support frames and the coil. The bolts pass through the pair of support frames, the coil, and the spacers in the central axis direction. The fastening members fix the coil and the spacers to the pair of support frames by being fastened to the bolts with the pair of support frames interposed. At least any one of the spacers is a variable spacer that includes a first member and a second member, the first member having one end face in the central axis direction and the one end having a recess, and the second member including a fitting portion fitted into the recess of the first member in the central axis direction, wherein the linear expansion coefficient of the second member is less than the linear expansion coefficient of the first member.

Advantageous Effects of Invention

According to the present disclosure, at least one variable spacer is disposed between the unit coils adjacent to each other in the central axis direction or between the support frame and the coil, whereby a load on the coil due to a thermal stress and due to vibrations of the running railroad vehicle can be reduced.

DESCRIPTION OF EMBODIMENTS

Figure 1:
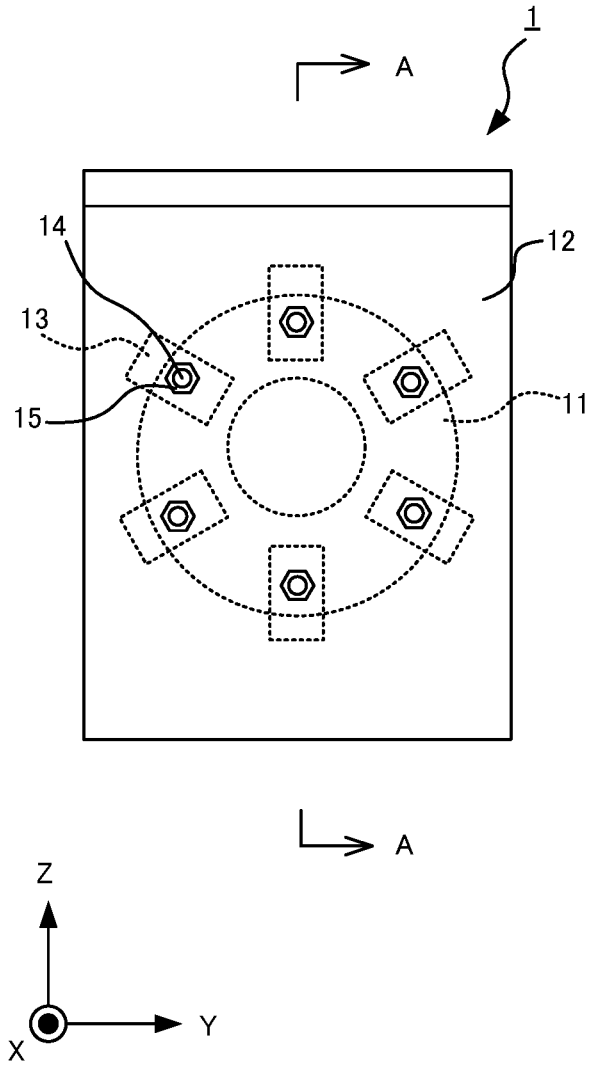
FIG. 1 is a side view of a reactor for vehicle according to Embodiment 1 of the present disclosure.

Embodiments of the present disclosure are described below in detail with reference to the drawings. In the drawings, components that are the same or equivalent are assigned the same reference signs.

Embodiment 1

Figure 2:
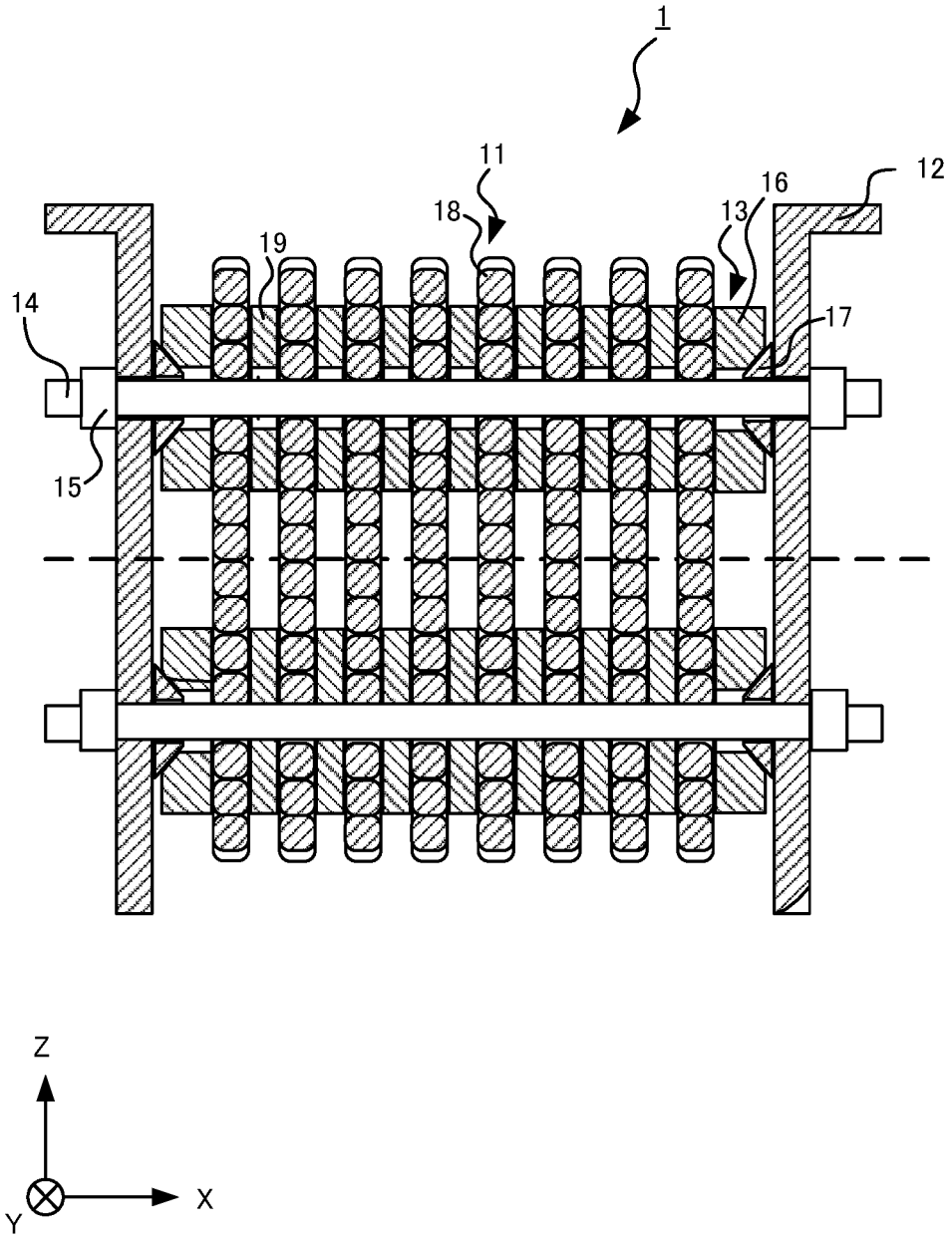
FIG. 2 is a cross-sectional view of the reactor for vehicle according to Embodiment 1.

FIG. 1 is a side view of a reactor for vehicle according to Embodiment 1 of the present disclosure. FIG. 2 is a cross-sectional view of the reactor for vehicle according to Embodiment 1. FIG. 2 is a cross-sectional view taken in line A-A in FIG. 1. A reactor 1 is installed in a railroad vehicle. The reactor 1 is an air-core reactor in the examples in FIGS. 1 and 2, but the reactor 1 may be an iron-core reactor. The reactor 1 may be of self-cooling type or forced-cooling type. In FIG. 2, a central axis of a coil 11 is indicated by a broken line. For example, the reactor 1 is attached to the railroad vehicle such that the reactor 1 is oriented with the central axis of the coil 11 horizontal when the railroad vehicle is located on a horizontal plane. In this case, in FIGS. 1 and 2, the Z-axis corresponds to a vertical direction, the X-axis corresponds to a horizontal direction, and the Y-axis corresponds to a direction orthogonal to the X-axis and to the Z-axis. The orientation of the reactor 1 attached to the vehicle is not limited to the above example. For example, the reactor 1 may be attached to the vehicle such that the reactor 1 is oriented with the central axis of the coil 11 coinciding with the vertical direction when the railroad vehicle is placed on a horizontal plane.

In an example described below, the central axis of the coil 11 is horizontal, that is, the X-axis direction is horizontal, when the vehicle is placed on a horizontal plane. The coil 11 includes unit coils 18 that are wound around the central axis and are arranged in the X-axis direction at intervals. The reactor 1 includes a pair of support frames 12 and one or more spacers, the support frames 12 face each other with the coil 11 sandwiched between the support frames 12 in the X-axis direction, and the spacer is disposed between unit coils 18 adjacent to each other in the X-axis direction or between the support frame 12 and the coil 11. For example, the spacer is an insulating spacer and is disposed between adjacent unit coils 18 to abut on the adjacent unit coils 18. In another example, the spacer is an insulating spacer and is disposed between the support frame 12 and the coil 11 to abut on the support frame 12 and the coil 11. In cases where the spacer does not have insulating properties, an insulating member is disposed between the spacer and the unit coil 18 or between the spacer and the support frame 12.

At least any one of the spacers is a variable spacer. In the example in FIG. 2, the reactor 1 includes the variable spacer 13 disposed between the support frame 12 and the coil 11. For example, when the temperature of the coil 11 rises due to energization of the coil 11 the length of the variable spacer 13 in the X-axis direction decreases. In other words, the length of the variable spacer 13 in the X-axis direction when the coil 11 carries an electric current is shorter than the length of the variable spacer 13 in the X-axis direction when the coil 11 does not carry electric current. In addition to the variable spacer 13, the reactor 1 may include an invariable spacer 19 whose length in the X-axis direction is regarded as constant irrespective of temperature of the coil 11. In the example in FIG. 2, the invariable spacer 19 is disposed between adjacent unit coils 18 to abut on the adjacent unit coils 18. In the example in FIG. 1, six variable spacers 13 are disposed on the same plane; however, any number of variable spacer 13 may be disposed on the same plane, and thus four variable spacers 13, for example, may be disposed on the same plane.

The coil 11, the pair of support frames 12, the variable spacer 13, and the invariable spacer 19 are passed through by bolts 14. Fastening members 15 are fastened to the bolts 14 with the pair of support frames 12 interposed between the fastening members 15, whereby the coil 11, the variable spacer 13, and the invariable spacer 19 are fixed to the support frames 12. The bolts 14 and the fastening members 15 are made of a metal having a rigidity value greater than or equal to a predetermined value, such as steel or stainless steel. The predetermined value is determined in accordance with the design of the reactor 1. The reactor 1 may include a cover covering the coil 11 around the central axis. Providing the variable spacer 13 and the invariable spacer 19 ensures that an air passage is created between the coil 11 and the support frames 12 and between adjacent unit coils 18, so that the cooling performance of the reactor 1 can be improved.

In the examples in FIGS. 1 and 2, each unit coil 18 is a disc-type coil wound around the central axis, and the reactor 1 includes the unit coils 18 arranged in the X-axis direction. The coil 11 is made of aluminum, copper, or the like. The coil 11 may be a coil conductor wound around the central axis in a helical manner. In this case, a portion per turn of the coil conductor wound around the central axis in a helical manner corresponds to the unit coil 18.

Figure 3:
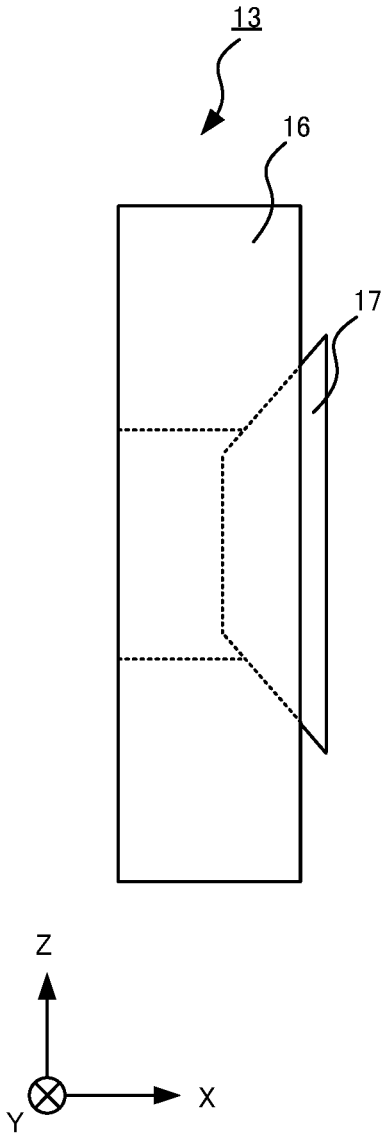
FIG. 3 is a front view of a variable spacer according to Embodiment 1.
Figure 4:
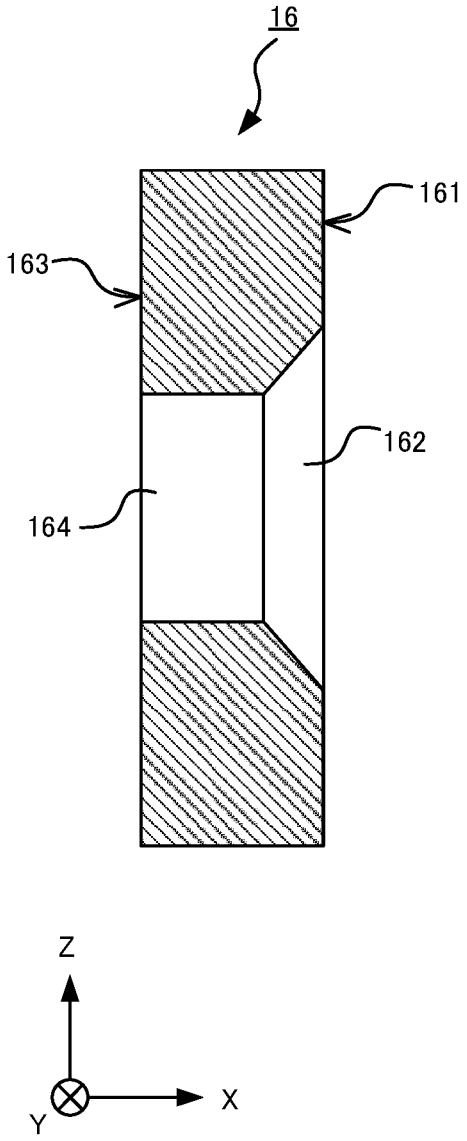
FIG. 4 is a cross-sectional view of a first member according to Embodiment 1.
Figure 5:
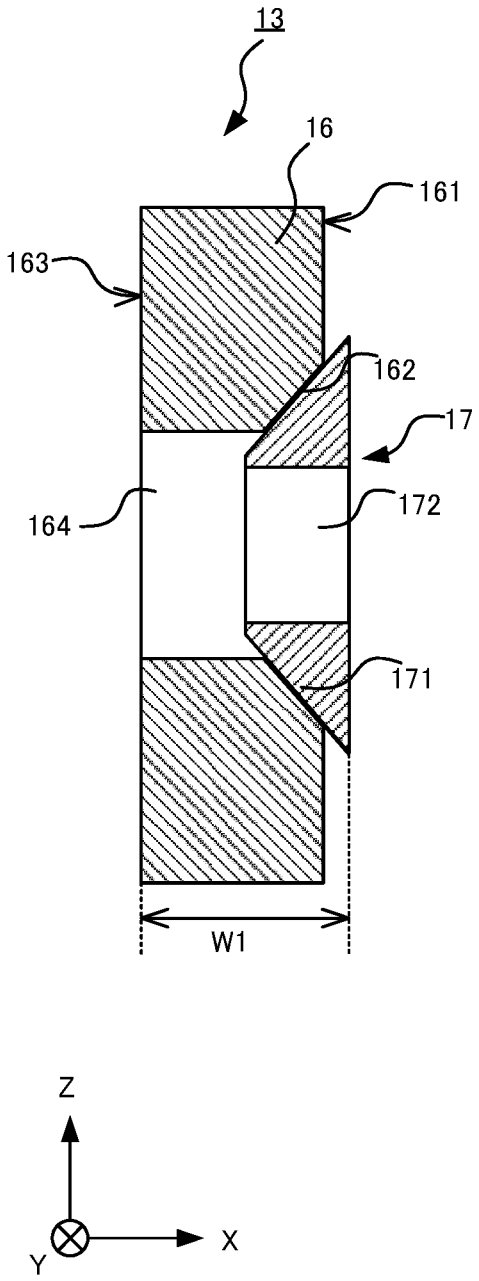
FIG. 5 is a cross-sectional view of the variable spacer according to Embodiment 1.
Figure 6:
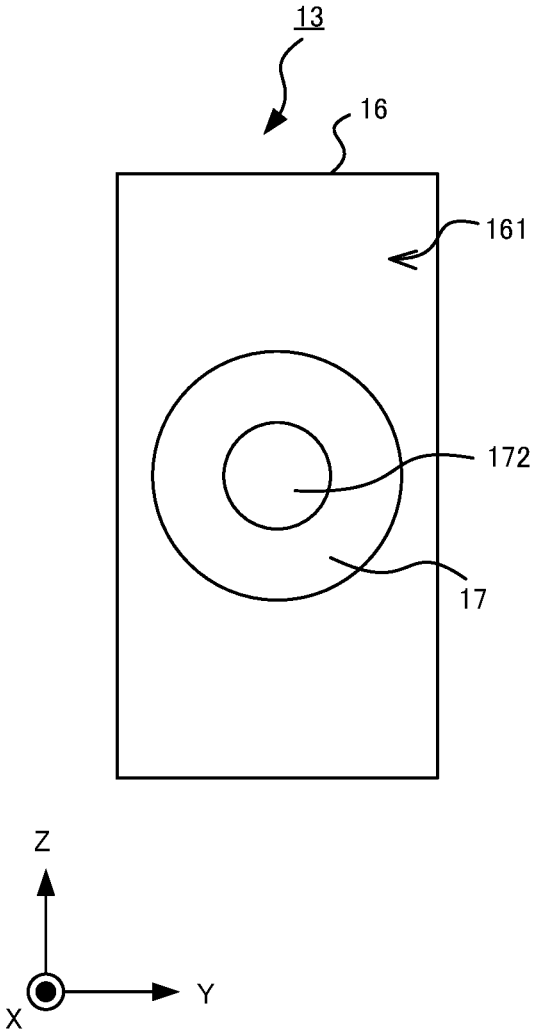
FIG. 6 is a side view of the variable spacer according to Embodiment 1.

FIG. 3 is a front view of the variable spacer according to Embodiment 1. FIG. 3 illustrates the variable spacer 13 disposed between a right-side support frame 12 and the coil 11 in FIG. 2. The variable spacer 13 includes a first member 16 and a second member 17. FIG. 4 is a cross-sectional view of the first member according to Embodiment 1. FIG. 5 is a cross-sectional view of the variable spacer according to Embodiment 1. FIG. 6 is a side view of the variable spacer according to Embodiment 1. The first member 16 includes one end face 161 with respect to the X-axis direction and the end face 161 is provided with a recess 162. The cross section of the recess 162 orthogonal to the X-axis direction becomes smaller toward the other end face 163 of the first member 16 with respect to the X-axis direction. The first member 16 has a through hole 164 through which the bolt 14 is to be inserted. The recess 162 and the through hole 164 communicate with each other.

The second member 17 includes a fitting portion 171 to be fitted into the recess 162 of the first member 16 in the X-axis direction. The linear expansion coefficient of the second member 17 is less than the linear expansion coefficient of the first member 16. Therefore, when the temperature of the coil 11 rises, the recess 162 is widened and the second member 17 moves in a negative X-axis direction as described later. Consequently, the length of the variable spacer 13 in the X-axis direction becomes shorter as the temperature of the coil 11 rises. The second member 17 has a through hole 172 through which the bolt 14 is to be inserted. The bolt 14 goes through the through holes 164 and 172 to pass in the X-axis direction through the first member 16 and the second member 17 that is fitted into the recess 162 of the first member 16. In the examples in FIGS. 3 to 6, the bolt 14 passes through the fitting portion 171 and then passes through the first member 16 and the second member 17. The bolt 14 goes through, for example, the center of gravity of the first member 16 and the center of gravity of the second member 17 to pass through the first member 16 and the second member 17.

A material used for the first member 16 is different from a material used for the second member 17 in linear expansion coefficient. For example, the first member 16 is made of an epoxy resin while the second member 17 is made of a ceramic. In another example, the first member 16 is made of insulated aluminum while the second member 17 is made of insulated iron.

In Embodiment 1, the one end face 161 of the first member 16 with respect to the X-axis direction has the recess 162 having a circular cross section orthogonal to the X-axis direction. The first member 16 is a rectangular solid in the examples in FIGS. 3 to 6. However, the first member 16 may be in any form, such as a cylinder extending in the X-axis direction. The second member 17 is a frustum of a cone having a bottom face orthogonal to the X-axis direction, and the radius of cross section of the frustum orthogonal to the X-axis direction becomes smaller toward the other end face 163 from the one end face 161 of the first member 16 with respect to the X-axis direction. An inner circumferential surface of the recess 162 of the first member 16 abuts on an outer circumferential surface of the second member 17. Both the inclination of the inner circumferential surface of the recess 162 of the first member 16 with respect to the central axis and the inclination of the outer circumferential surface of the second member 17 with respect to the central axis can be determined as appropriate depending on how much the coil 11 expands when the temperature of the coil 11 rises.

Figure 7:
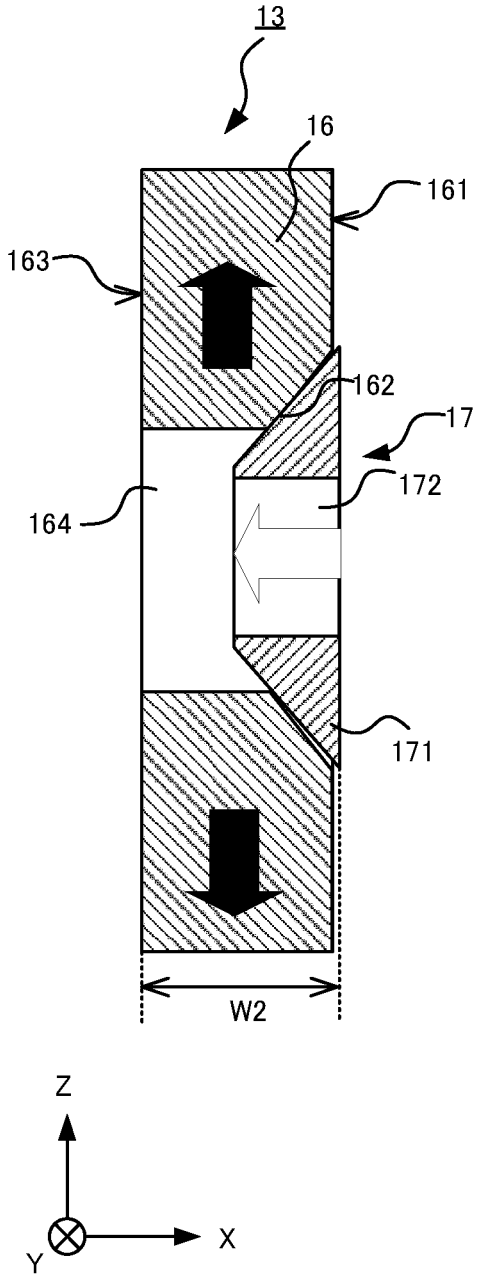
FIG. 7 illustrates an example change in shape of the variable spacer according to Embodiment 1.

FIG. 7 illustrates an example change in shape of the variable spacer according to Embodiment 1. FIG. 7 illustrates an example change in shape of the variable spacer 13 occurring when the temperature of the coil 11 rises. For example, when the coil 11 is energized and the temperature of the coil rises, the coil 11 expands. The rise in temperature of the coil 11 is accompanied by the rise in temperature of the first member 16 abutting on the coil 11 and the rise in temperature of the second member 17 fitted into the recess 162 of the first member 16. The rise in temperature causes both the first member 16 and the second member 17 to expand. For example, in comparison with the case in which the coil 11 is not energized, when the coil 11 is energized, the first member 16 expands and the recess 162 and the through hole 164 are widened, as indicated by black arrows in FIG. 7. As the recess 162 is widened, the second member 17 pressed by the expanding coil 11 in the X-axis direction moves in the negative X-axis direction, as indicated by an outlined-type arrow in FIG. 7. Since the linear expansion coefficient of the second member 17 is less than the linear expansion coefficient of the first member 16, the recess 162 is widened to a larger extent than the expansion of the second member 17. As a result, the second member 17 pressed by the coil 11 in the X-axis direction moves in the negative X-axis direction, whereby the variable spacer 13 becomes shorter in length in the X-axis direction. Although the temperature of the coil 11 rises and the coil 11 expands, the coil 11 does not suffer a thermal stress because the variable spacer 13 abutting on the coil 11 becomes shorter in length in the X-axis direction.

Figure 8:
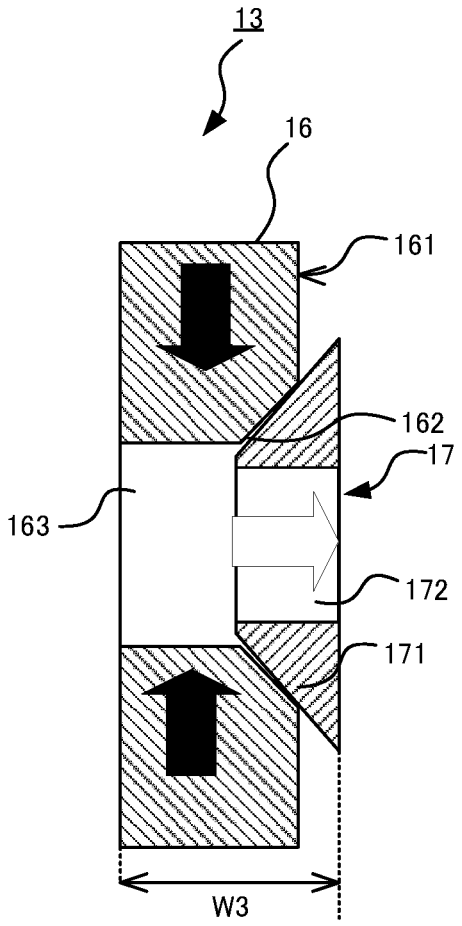
FIG. 8 illustrates an example change in shape of the variable spacer according to Embodiment 1.
Figure 8:
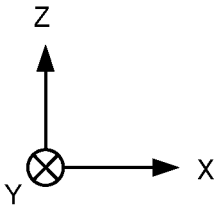

FIG. 8 illustrates an example change in shape of the variable spacer according to Embodiment 1. FIG. 8 illustrates an example change in shape of the variable spacer 13 occurring when the temperature of the coil 11 drops. For example, when the coil 11 changes the state from an energized state to a non-energized state or when the ambient temperature drops, the temperature of the coil 11 drops and thus the coil 11 contracts. The drop in the temperature of the coil 11 is accompanied by a drop in the temperature of the first member 16 abutting on the coil 11 and a drop in the temperature of the second member 17 fitted into the recess 162 of the first member 16. The drop in temperature causes both the first member 16 and the second member 17 to contract. For example, in comparison with the case in which the coil 11 carries an electric current, when the coil 11 does not carry an electric current, the first member 16 contracts and the recess 162 and the through hole 164 contract, as indicated by black arrows in FIG. 8. As the coil 11 contracts and the recess 162 contracts, the second member 17 pressed by the first member 16 in the X-axis direction moves in a positive X-axis direction, as indicated by an outlined-type arrow in FIG. 8. Since the linear expansion coefficient of the second member 17 is less than the linear expansion coefficient of the first member 16, the recess 162 contracts to a larger extent than the contraction of the second member 17. As a result, the second member 17 pressed by the first member 16 moves in the positive X-axis direction, whereby the variable spacer 13 becomes longer in length in the X-axis direction. Although the temperature in the coil 11 drops and the coil 11 contracts, displacement of the coil 11 in the X-axis direction with respect to the support frame 12 can be inhibited because the variable spacer abutting on the coil 11 has a longer length in the X-axis direction.

FIG. 5 illustrates the variable spacer 13 when, for example, the environment temperature is an ordinary temperature and the coil 11 is carrying no electric current. The ordinary temperature refers to a temperature in a predetermined range of temperatures including 20 degrees centigrade, for example. FIG. 7 illustrates the variable spacer 13 when, for example, the environment temperature is an ordinary temperature and the coil 11 carries an electric current. FIG. 8 illustrates the variable spacer 13 when, for example, the environment temperature is −10 degrees centigrade and the coil 11 does not carry an electric current. The length of the variable spacer 13 in the X-axis direction is represented by symbol W1 in the example in FIG. 5, a symbol W2 in the example in FIG. 7, and a symbol W3 in the example in FIG. 8. The length of W2 is less than the length of W1, and the length of W3 is greater than the length of W1. Although the temperature of the coil 11 rises and the coil 11 expands due to energization of the coil 11, the coil 11 does not suffer a thermal stress because the variable spacer 13 becomes shorter in length in the X-axis direction as illustrated in FIG. 7. On the other hand, although the coil 11 contracts due to the drop in the temperature of the surrounding environment around the reactor 1, the displacement of the coil 11 in the X-axis direction with respect to the support frame 12 can be inhibited because the variable spacer 13 becomes longer in length in the X-axis direction to create a gap between the variable spacer 13 and the coil 11, as illustrated in FIG. 8.

Figure 9:
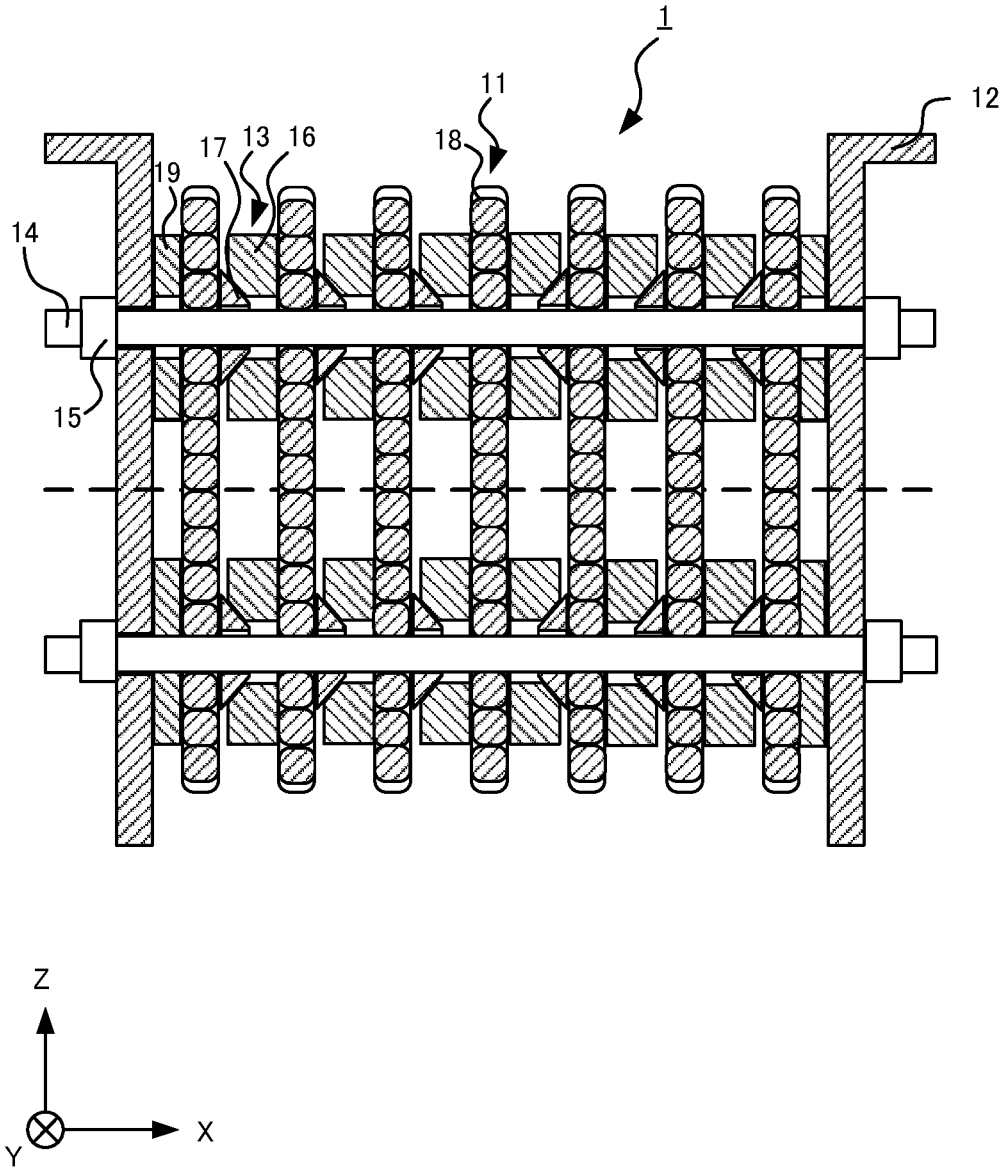
FIG. 9 is a cross-sectional view of a variation of the reactor for vehicle according to Embodiment 1.

FIG. 9 is a cross-sectional view of a variation of the reactor for vehicle according to Embodiment 1. As illustrated in FIG. 9, the variable spacer 13 may be disposed between adjacent unit coils 18. When the temperature of the coil 11 is an ordinary temperature, the variable spacers 13 each disposed between the unit coils 18 may be different from one another in length in the X-axis direction or may have the same length in the X-axis direction. For example, the variable spacer 13 may have a greater length in the X-axis direction as the difference between distances from the pair of support frames 12 to the variable spacer 13 becomes smaller, that is, as the variable spacer 13 comes closer to the center from both ends of the coil 11 with respect to the X-axis direction. As a result, such a structure can improve cooling efficiency in cooling the middle region of the coil 11 with respect to the X-axis direction, the middle region having a greater temperature rise than the ends of the coil 11 with respect to the X-axis direction when the coil 11 carries an electric current. The variable spacer 13 may also be disposed both between the adjacent unit coils 18 and between the support frame 12 and the coil 11.

As described above, the reactor 1 according to Embodiment 1 includes at least one variable spacer 13 disposed between unit coils 18 adjacent to each other in the central axis direction or between the support frame 12 and the coil 11, and the variable spacer 13 becomes shorter in length in the central axis direction with a rise in the temperature of the coil 11. Consequently, a load on the coil 11 due to a thermal stress caused by a rise in the temperature of the coil 11 and due to vibrations of the running railroad vehicle can be reduced.

Embodiment 2

Figure 10:
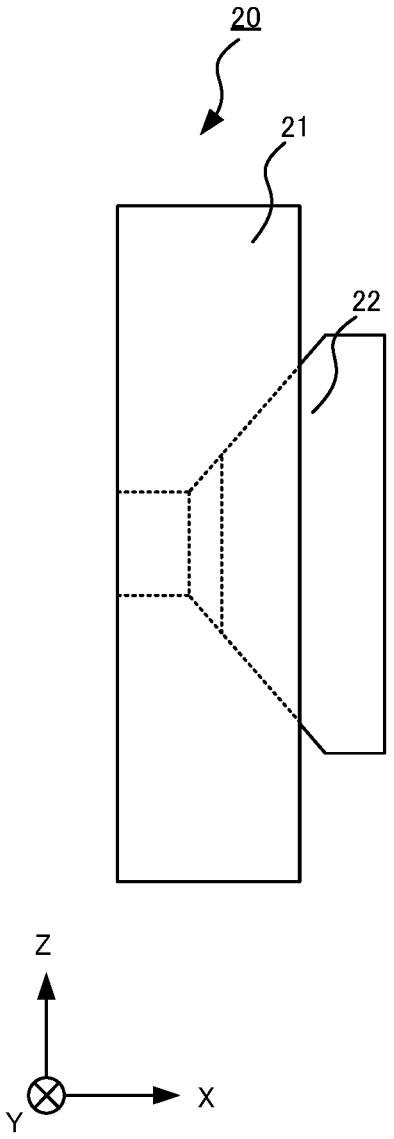
FIG. 10 is a front view of a variable spacer according to Embodiment 2 of the present disclosure.
Figure 11:
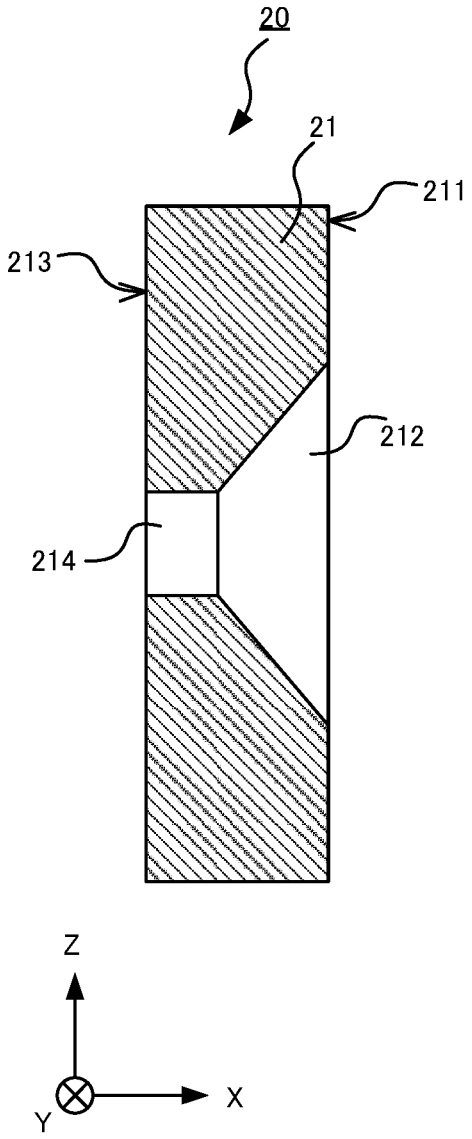
FIG. 11 is a cross-sectional view of a first member according to Embodiment 2.
Figure 12:
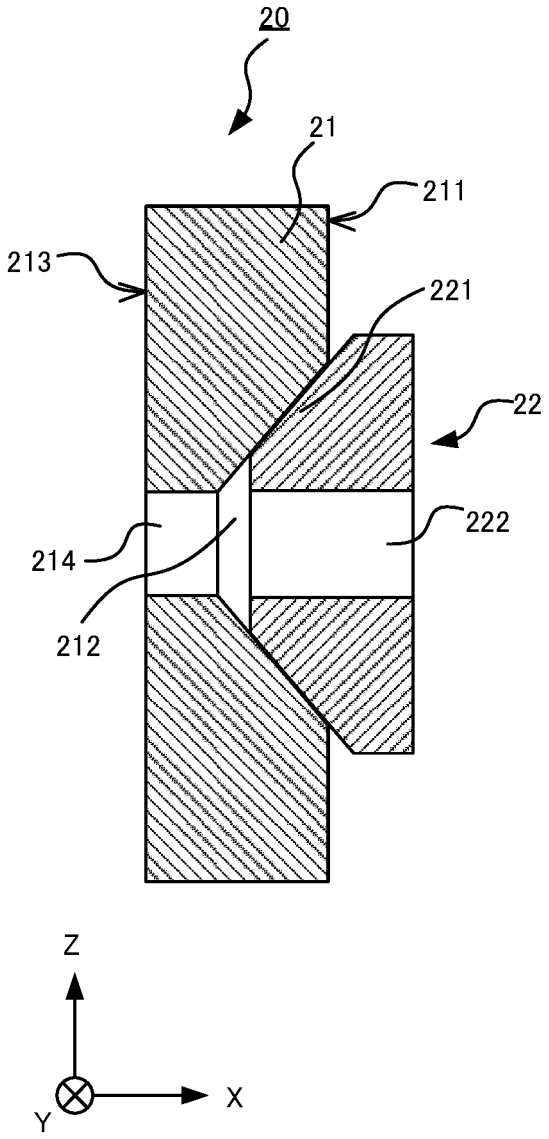
FIG. 12 is a cross-sectional view of the variable spacer according to Embodiment 2.
Figure 13:
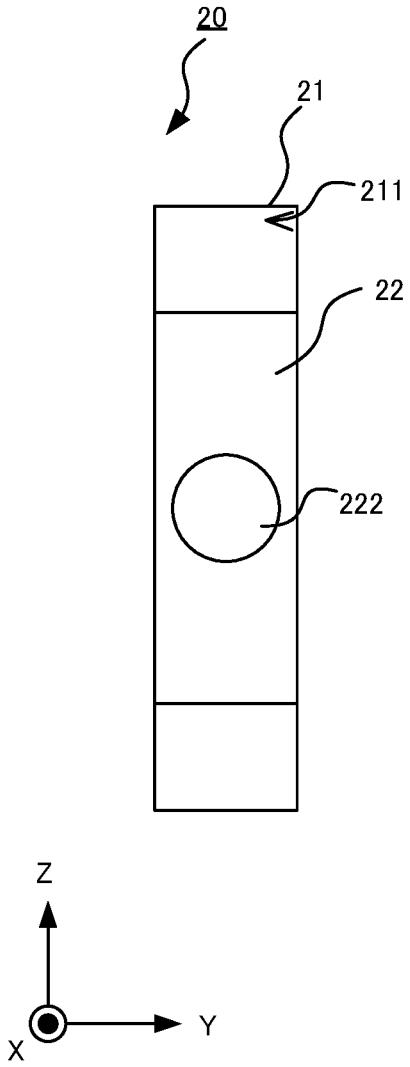
FIG. 13 is a side view of the variable spacer according to Embodiment 2.

A reactor 1 according to Embodiment 2 is configured in the same way as in Embodiment 1. FIG. 10 is a front view of a variable spacer according to Embodiment 2 of the present disclosure. The reactor 1 according to Embodiment 2 includes a variable spacer 20. The variable spacer 20 includes a first member 21 and a second member 22. FIG. 11 is a cross-sectional view of the first member according to Embodiment 2. FIG. 12 is a cross-sectional view of the variable spacer according to Embodiment 2. FIG. 13 is a side view of the variable spacer according to Embodiment 2. The first member 21 has one end face 211 of with respect to the X-axis direction and the one end face 211 has a recess 212. The cross section of the recess 212 orthogonal to the X-axis direction becomes smaller toward the other end face 213 from the one end face 211 of the first member 21 with respect to the X-axis direction. The first member 21 has a through hole 214 through which the bolt 14 is to be inserted.

The second member 22 includes a fitting portion 221 to be fitted into the recess 212 of the first member 21 in the X-axis direction. The linear expansion coefficient of the second member 22 is less than the linear expansion coefficient of the first member 21. Therefore, when the temperature of the coil 11 rises, the recess 212 is widened and the second member 22 moves in the negative X-axis direction as described later. As a result, the length of the variable spacer 20 in the X-axis direction in the case of the rise in the temperature of the coil 11 is shorter than the length of the variable spacer 20 in the X-axis direction when the temperature of the coil 11 is an ordinary temperature. The second member 22 has a through hole 222 through which the bolt 14 is to be inserted. The bolt 14 goes through the through holes 214 and 222 to pass through the first member 21 and the second member 22 in the X-axis direction. In the examples in FIGS. 10 to 13, the bolt 14 passes through the fitting portion 221 and then passes through the first member 21 and the second member 22. The bolt 14 goes through, for example, the center of gravity of the first member 21 and the center of gravity of the second member 22 to pass through the first member 21 and the second member 22.

As in Embodiment 1, a material used for the first member 21 is different from a material used for the second member 22 in linear expansion coefficient. In Embodiment 2, the one end face 211 of the first member 21 with respect to the X-axis direction has the recess 212 having a rectangular cross section orthogonal to the X-axis direction. In the examples in FIGS. 10 to 13, the first member 21 is a rectangular solid. The fitting portion 221 of the second member 22 has a rectangular cross section orthogonal to the X-axis direction. The cross section of the fitting portion 221 orthogonal to the X-axis direction becomes smaller toward the other end face 213 from the one end face 211 of the first member 21 with respect to the X-axis direction.

In FIG. 2, the Z-axis direction coincides with a radial direction with respect to the central axis. Hence, the Z-axis direction in FIGS. 10 to 13 also coincides with a radial direction with respect to the central axis. In the examples in FIGS. 10 to 13, the shape of the cross section of the recess 212 in the central axis and the radial direction with respect to the central axis, that is, in the X-axis and the Z-axis, is an isosceles trapezoid. Likewise, the shape of the cross section of the fitting portion 221 in the X-axis and the Z-axis is an isosceles trapezoid. In the examples in FIGS. 10 to 13, when the temperature of the coil 11 rises, the temperature of the first member 21 and the temperature of the second member 22 rise, as in Embodiment 1. The length of the variable spacer 20 in the X-axis direction becomes shorter with rises in the temperature of the first member 21 and the temperature of the second member 22. Thus, although the temperature of the coil 11 rises and the coil 11 expands, the coil 11 does not suffer a thermal stress because the variable spacer 20 abutting on the coil 11 becomes shorter in length in the X-axis direction. When the temperature of the coil 11 drops, the temperature of the first member 21 and the temperature of the second member 22 also drop. The length of the variable spacer 20 in the X-axis direction becomes longer with a drop in the temperature of the first member 21 and the temperature of the second member 22. Thus, although the temperature of the coil 11 drops and the coil 11 contracts, the displacement of the coil 11 in the X-axis direction with respect to the support frame 12 can be inhibited because the variable spacer 20 abutting on the coil 11 becomes longer in length in the X-axis direction.

Figure 14:
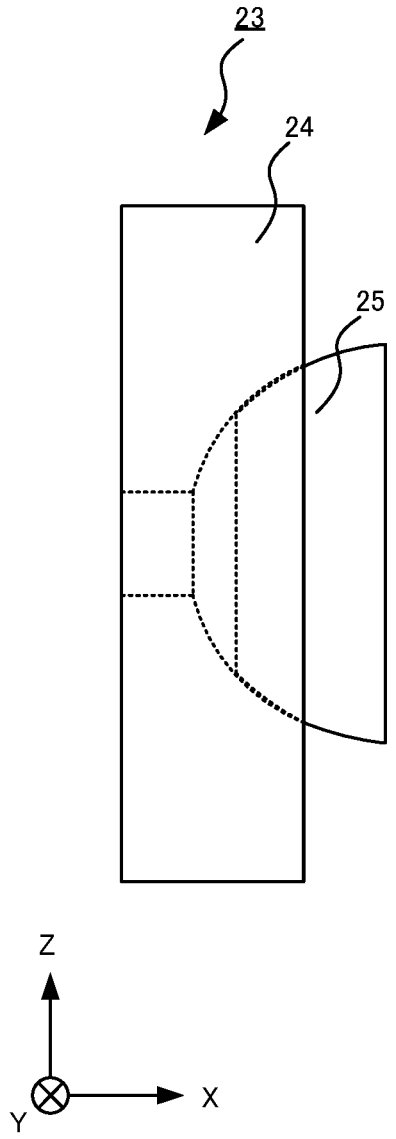
FIG. 14 is a front view of a first variation of the variable spacer according to Embodiment 2.
Figure 15:
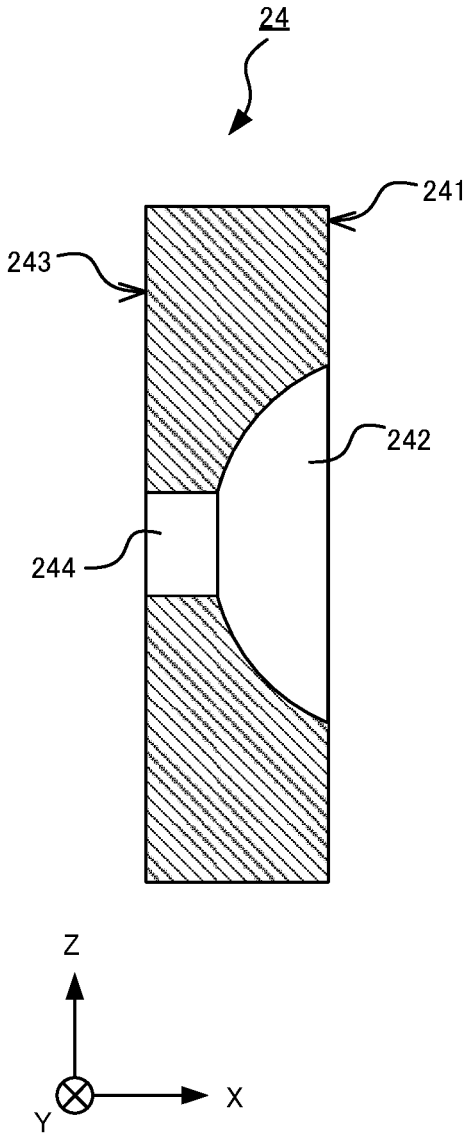
FIG. 15 is a cross-sectional view of the first variation of the first member according to Embodiment 2.
Figure 16:
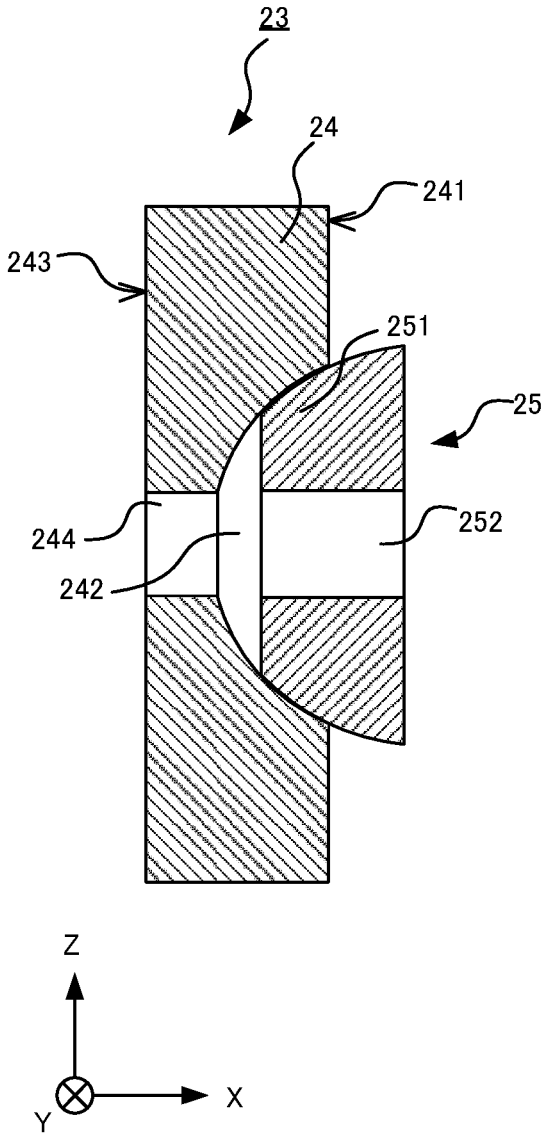
FIG. 16 is a cross-sectional view of the first variation of the variable spacer according to Embodiment 2.
Figure 17:
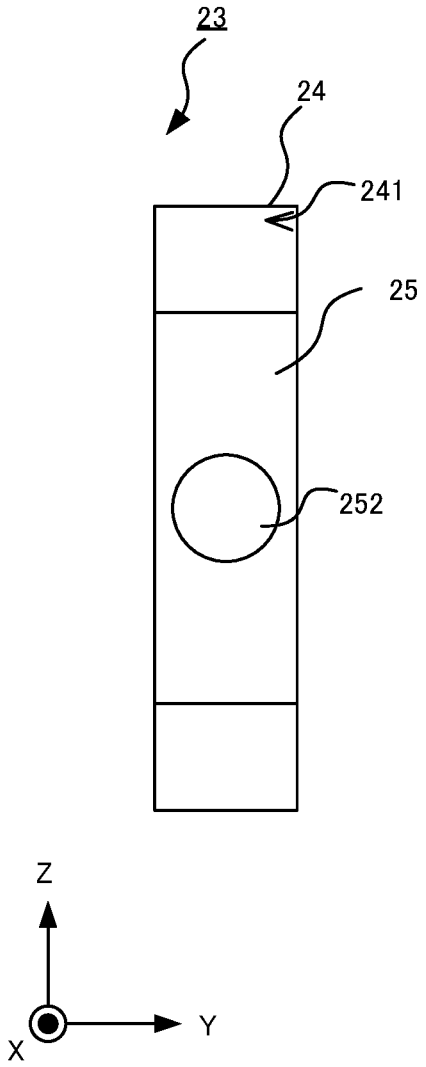
FIG. 17 is a side view of the first variation of the variable spacer according to Embodiment 2.

The reactor 1 according to Embodiment 2 may include a variable spacer 23 described below. FIG. 14 is a front view of a first variation of the variable spacer according to Embodiment 2. The variable spacer 23 includes a first member 24 and a second member 25. FIG. 15 is a cross-sectional view of the first variation of the first member according to Embodiment 2. FIG. 16 is a cross-sectional view of the first variation of the variable spacer according to Embodiment 2. FIG. 17 is a side view of the first variation of the variable spacer according to Embodiment 2. The first member 24 has one end face 241 with respect to the X-axis direction and the one end face 241 has a recess 242. The cross section of the recess 242 orthogonal to the X-axis direction becomes smaller toward the other end face 243 with respect to the X-axis direction. The first member 24 has a through hole 244 through which the bolt 14 is to be inserted.

The second member 25 includes a fitting portion 251 to be fitted into the recess 242 of the first member 24 in the X-axis direction. The linear expansion coefficient of the second member 25 is less than the linear expansion coefficient of the first member 24. Therefore, for example, when the coil 11 carries an electric current, the recess 242 is widened and the second member 25 moves in the negative X-axis direction, as in the foregoing examples. As a result, the length of the variable spacer 23 in the X-axis direction in a case in which the coil 11 is energized is shorter than the length of the variable spacer 23 in the X-axis direction in the case in which the coil 11 is not energized. The second member 25 has a through hole 252 through which the bolt 14 is to be inserted. The bolt 14 goes through the through holes 244 and 252 to pass through the first member 24 and the second member 25 in the X-axis direction. In the examples in FIGS. 14 to 17, the bolt 14 passes through the fitting portion 251 and then passes through the first member 24 and the second member 25. The bolt 14 goes through, for example, the center of gravity of the first member 24 and the center of gravity of the second member 25 to pass through the first member 24 and the second member 25.

As in Embodiment 1, a material used for the first member 24 is different from a material used for the second member 25 in linear expansion coefficient. The first member 24 is a rectangular solid and has one end face 241 with respect to the X-axis direction, and the one end face 241 has the recess 242 having a rectangular cross section orthogonal to the X-axis direction. The second member 22 has a rectangular cross section orthogonal to the X-axis direction. The cross section of the fitting portion 251 orthogonal to the X-axis direction becomes smaller toward the other end face 243 from the one end face 241 of the first member 24 with respect to the X-axis direction. As in the foregoing examples, the Z-axis direction in FIGS. 14 to 17 coincides with a radial direction with respect to the central axis. In the examples in FIGS. 14 to 17, the shape of the cross section of the recess 242 in the central axis and the radial direction with respect to the central axis, that is, in cross section in the X-axis and the Z-axis, is arcuate. Likewise, the shape of the cross section of the fitting portion 251 in the X-axis and the Z-axis is arcuate.

In the examples in FIGS. 14 to 17, when the temperature of the coil 11 rises, the temperature of the first member 24 and the temperature of the second member 25 also rise, as in Embodiment 1. The length of the variable spacer 23 in the X-axis direction becomes shorter with rises in the temperature of the first member 24 and the temperature of the second member 25. Thus, although the temperature of the coil 11 rises and the coil 11 expands, the coil 11 does not suffer a thermal stress because the variable spacer 23 abutting on the coil 11 becomes shorter in length in the X-axis direction. When the temperature of the coil 11 drops, the temperature of the first member 24 and the temperature of the second member 25 also drop. The length of the variable spacer 23 in the X-axis direction becomes longer with a drop in the temperature of the first member 24 and the temperature of the second member 25. Thus, although the temperature of the coil 11 drops and the coil 11 contracts, the displacement of the coil 11 in the X-axis direction with respect to the support frame 12 can be inhibited because the variable spacer 23 abutting on the coil 11 becomes longer in length in the X-axis direction.

Figure 18:
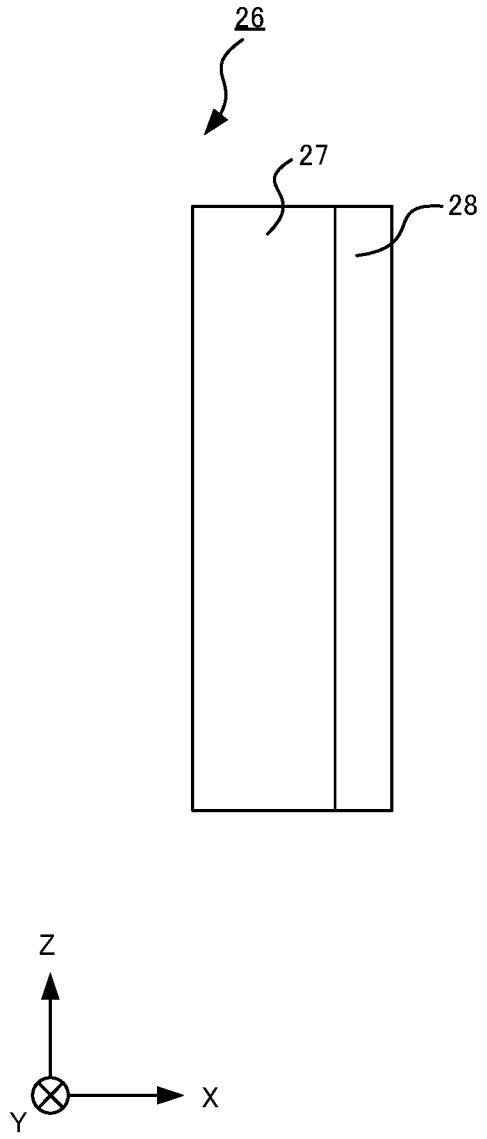
FIG. 18 is a front view of a second variation of the variable spacer according to Embodiment 2.
Figure 19:
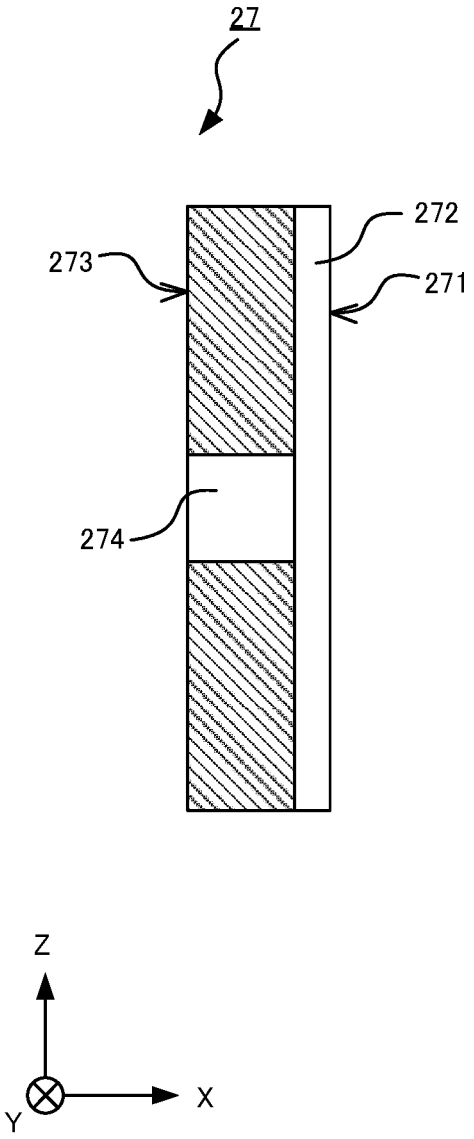
FIG. 19 is a cross-sectional view of the second variation of the first member according to Embodiment 2.
Figure 20:
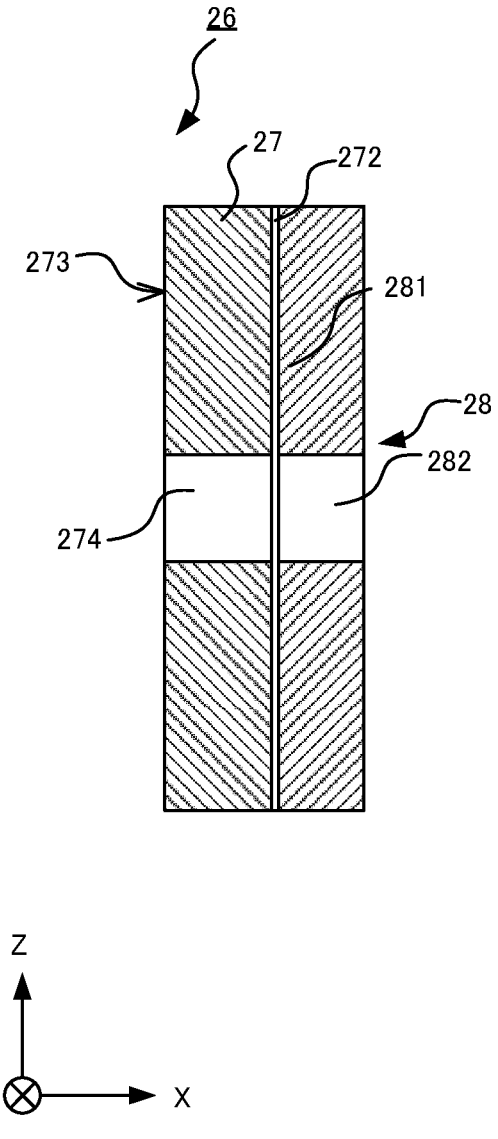
FIG. 20 is a cross-sectional view of the second variation of the variable spacer according to Embodiment 2.
Figure 21:
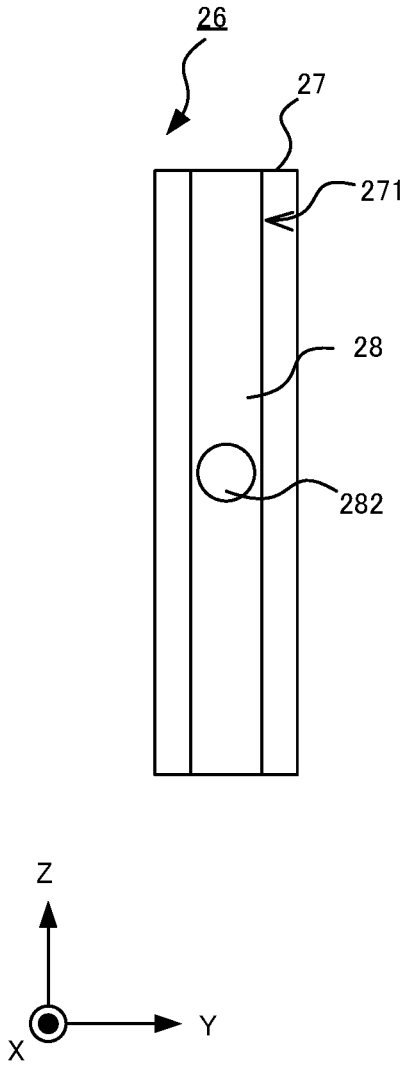
FIG. 21 is a side view of the second variation of the variable spacer according to Embodiment 2.
Figure 22:
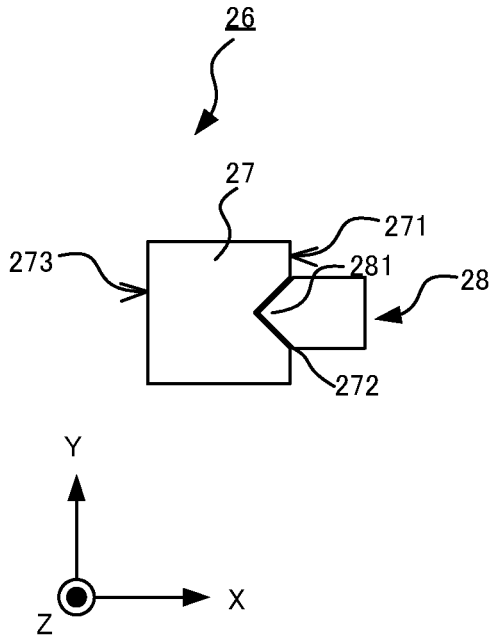
FIG. 22 is a top view of the second variation of the variable spacer according to Embodiment 2.

The reactor 1 according to Embodiment 2 may include a variable spacer 26 described below. FIG. 18 is a front view of a second variation of the variable spacer according to Embodiment 2. The variable spacer 26 includes a first member 27 and a second member 28. FIG. 19 is a cross-sectional view of the second variation of the first member according to Embodiment 2. FIG. 20 is a cross-sectional view of the second variation of the variable spacer according to Embodiment 2. FIG. 21 is a side view of the second variation of the variable spacer according to Embodiment 2. FIG. 22 is a top view of the second variation of the variable spacer according to Embodiment 2. The first member 27 has one end face 271 with respect to the X-axis direction and the one end face 271 has a recess 272. The cross section of the recess 272 orthogonal to the X-axis direction becomes smaller toward the other end face 273 with respect to the X-axis direction. The first member 27 has a through hole 274 through which the bolt 14 is to be inserted.

The second member 28 includes a fitting portion 281 to be fitted into the recess 272 of the first member 27 in the X-axis direction. The linear expansion coefficient of the second member 28 is less than the linear expansion coefficient of the first member 27. Therefore, when the temperature of the coil 11 rises, the recess 272 is widened and the second member 28 moves in the negative X-axis direction, as in the foregoing examples. Consequently, the length of the variable spacer 26 in the X-axis direction becomes shorter with a rise in the temperature of the coil 11. The second member 28 has a through hole 282 through which the bolt 14 is to be inserted. The bolt 14 goes through the through holes 274 and 282 and then passes through the first member 27 and the second member 28 in the X-axis direction. In the examples in FIGS. 18 to 22, the bolt 14 passes through the fitting portion 281 to pass through the first member 27 and the second member 28. The bolt 14 goes through, for example, the center of gravity of the first member 27 and the center of gravity of the second member 28 to pass through the first member 27 and the second member 28.

As in Embodiment 1, a material used for the first member 27 is different from a material used for the second member 28 in linear expansion coefficient. The one end face 271 of the first member 27 with respect to the X-axis direction has the recess 272 having a rectangular cross section orthogonal to the X-axis direction. The recess 272 is a groove extending in a radial direction with respect to the central axis. The fitting portion 281 of the second member 28 has a rectangular cross section orthogonal to the X-axis direction. As in the foregoing examples, the Z-axis direction in FIGS. 18 to 22 coincides with a radial direction with respect to the central axis. In the examples in FIGS. 18 to 22, a cross section of the fitting portion 281 orthogonal to the central axis becomes smaller in length in the direction orthogonal to a radial direction with respect to the central axis, that is, in length in the Y-axis direction, which is orthogonal to the Z-axis direction, toward the other end face 273 from the one end face 271 of the first member 27 with respect to the X-axis direction.

In the examples in FIGS. 18 to 22, when the temperature of the coil 11 rises, the temperature of the first member 27 and the temperature of the second member 28 also rise, as in Embodiment 1. The length of the variable spacer 26 in the X-axis direction becomes shorter with rises in the temperature of the first member 27 and the temperature of the second member 28. Thus, although the temperature of the coil 11 rises and the coil 11 expands, the coil 11 does not suffer a thermal stress because the variable spacer 26 abutting on the coil 11 becomes shorter in length in the X-axis direction. A drop in the temperature of the coil 11 is accompanied by a drop in the temperature of the first member 27 abutting on the coil 11 and a drop in the temperature of the second member 28 fitted into the recess 272 of the first member 27. The length of the variable spacer 26 in the X-axis direction becomes longer with a drop in the temperature of the first member 27 and the temperature of the second member 28. Thus, although the temperature of the coil 11 drops and the coil 11 contracts, the displacement of the coil 11 in the X-axis direction with respect to the support frame 12 can be inhibited because the variable spacer 23 abutting on the coil 11 becomes longer in length in the X-axis direction.

As described above, the reactor 1 according to Embodiment 2 includes at least one variable spacer 20, 23, 26 disposed between unit coils 18 adjacent to each other in the central axis direction or between the support frame 12 and the coil 11, and the variable spacer 20, 23, 26 becomes shorter in length in the central axis direction with a rise in the temperature of the coil 11. Consequently, a load on the coil 11 due to a thermal stress caused by a rise in the temperature of the coil 11 and due to vibrations of the running railroad vehicle can be reduced.

The present disclosure is not limited to the foregoing embodiments. The reactor 1 may include any combination of the variable spacers 13, 20, 23, and 26. Positions of the variable spacers 13, 20, 23, and 26 are not limited to those illustrated in the foregoing examples. For example, the variable spacers 13, 20, 23, and 26 may be disposed in every other space between adjacent unit coils 18.

The foregoing describes some example embodiments for explanatory purposes. Although the foregoing discussion has presented specific embodiments, persons skilled in the art will recognize that changes may be made in form and detail without departing from the broader spirit and scope of the invention. Accordingly, the specification and drawings are to be regarded in an illustrative rather than a restrictive sense. This detailed description, therefore, is not to be taken in a limiting sense, and the scope of the invention is defined only by the included claims, along with the full range of equivalents to which such claims are entitled.

REFERENCE SIGNS LIST

| | |
|---|---|
| 1 | Reactor |
| 11 | Coil |
| 12 | Support frame |
| 13, 20, 23, 26 | Variable spacer |
| 14 | Bolt |
| 15 | Fastening member |
| 16, 21, 24, 27 | First member |
| 17, 22, 25, 28 | Second member |
| 18 | Unit coil |
| 19 | Invariable spacer |
| 161, 163, 211, 213, 241, 243, 271, 273 | End face |
| 162, 212, 242, 272 | Recess |
| 164, 172, 214, 222, 244, 252, 274, 282 | Through hole |
| 171, 221, 251, 281 | Fitting portion |

The invention claimed is:

1. A reactor for a vehicle comprising:

a coil comprising unit coils wound around a central axis, the unit coils being adjacent to each other with a space therebetween in a central axis direction that is a direction of the central axis;

a pair of support frames facing each other in the central axis direction with the coil sandwiched between the pair of support frames;

one or more spacers each disposed between the unit coils adjacent to each other in the central axis direction or between each of the support frames and the coil;

bolts passing through the pair of support frames, the coil, and the spacers in the central axis direction; and fastening members fastened to the bolts to sandwich the pair of support frames so that the coil and the spacers are fixed relative to the pair of support frames, wherein at least one of the spacers is a variable spacer comprising:

a first member having one end face in the central axis direction, the one end face having a recess; and a second member comprising a fitting portion fitted into the recess of the first member in the central axis direction, wherein a linear thermal expansion coefficient of the second member is less than a linear thermal expansion coefficient of the first member.

2. The reactor according to claim 1, wherein a length of the variable spacer in the central axis direction when the coil is energized is shorter than the length of the variable spacer in the central axis direction when the coil is not energized.

3. The reactor according to claim 1, wherein the recess becomes smaller in cross section orthogonal to the central axis toward another end face of the first member from the one end face of the first member in the central axis direction.

4. The reactor according to claim 2, wherein the recess becomes smaller in cross section orthogonal to the central axis toward another end face of the first member from the one end face of the first member in the central axis direction.

5. The reactor according to claim 3, wherein the recess of the one end face of the first member in the central axis direction has a circular cross section orthogonal to the central axis, and the fitting portion included in the second member is a frustum of a cone having a bottom face is orthogonal to the central axis direction, and the fitting portion becomes smaller in radius of cross section orthogonal to the central axis direction toward the another end face of the first member from the one end face of the first member in the central axis direction.

6. The reactor according to claim 4, wherein the recess of the one end face of the first member in the central axis direction has a circular cross section orthogonal to the central axis, and the fitting portion included in the second member is a frustum of a cone having a bottom face is orthogonal to the central axis direction, and the fitting portion becomes smaller in radius of cross section orthogonal to the central axis direction toward the another end face of the first member from the one end face of the first member in the central axis direction.

7. The reactor according to claim 3, wherein the recess of the one end face of the first member in the central axis direction has a rectangular-shaped cross section orthogonal to the central axis, the fitting portion has a rectangular shape in cross section orthogonal to the central axis, and the fitting portion becomes smaller in cross section orthogonal to the central axis toward the another end face of the first member from the one end face of the first member in the central axis direction.

8. The reactor according to claim 4, wherein the recess of the one end face of the first member in the central axis direction has a rectangular-shaped cross section orthogonal to the central axis, the fitting portion has a rectangular shape in cross section orthogonal to the central axis, and the fitting portion becomes smaller in cross section orthogonal to the central axis toward the another end face of the first member from the one end face of the first member in the central axis direction.

9. The reactor according to claim 7, wherein the recess has an isosceles trapezoid-shaped cross section in the central axis and in a radial direction with respect to the central axis, and the fitting portion has an isosceles trapezoid-shaped cross section in the central axis and in the radial direction.

10. The reactor according to claim 8, wherein the recess has an isosceles trapezoid-shaped cross section in the central axis and in a radial direction with respect to the central axis, and the fitting portion has an isosceles trapezoid-shaped cross section in the central axis and in the radial direction.

11. The reactor according to claim 7, wherein the recess has an arcuate cross section in the central axis and in a radial direction with respect to the central axis, and the fitting portion has an arcuate cross section in the central axis and in the radial direction.

12. The reactor according to claim 8, wherein the recess has an arcuate cross section in the central axis and in a radial direction with respect to the central axis, and the fitting portion has an arcuate cross section in the central axis and in the radial direction.

13. The reactor according to claim 3, wherein the recess is a groove extending in a radial direction with respect to the central axis, the cross section of the recess orthogonal to the central axis has a length in the direction orthogonal to the radial direction, the length of the cross section of the recess in the direction orthogonal to the radial direction becoming smaller toward the another end face of the first member from the one end face of the first member in the central axis direction, and a cross section of the fitting portion orthogonal to the central axis has a length in the direction orthogonal to the radial direction, the length of the cross section of the fitting portion in the direction orthogonal to the radial direction becoming smaller toward the another end face of the first member from the one end face of the first member in the central axis direction.

14. The reactor according to claim 4, wherein the recess is a groove extending in a radial direction with respect to the central axis, the cross section of the recess orthogonal to the central axis has a length in the direction orthogonal to the radial direction, the length of the cross section of the recess in the direction orthogonal to the radial direction becoming smaller toward the another end face of the first member from the one end face of the first member in the central axis direction, and a cross section of the fitting portion orthogonal to the central axis has a length in the direction orthogonal to the radial direction, the length of the cross section of the fitting portion in the direction orthogonal to the radial direction becoming smaller toward the another end face of the first member from the one end face of the first member in the central axis direction.

15. The reactor according to claim 1, wherein the bolt passing through the fitting portion passes through the first member and the second member in the central axis direction.

16. The reactor according to claim 1, wherein the bolt passing through a center of gravity of the first member and a center of gravity of the second member passes through the first member and the second member.

17. The reactor according to claim 1, wherein the variable spacer is disposed between each of the support frames and the coil, the first member abuts on the coil, and the second member abuts on each of the support frames.

18. The reactor according to claim 2, wherein the variable spacer is disposed between each of the support frames and the coil, the first member abuts on the coil, and the second member abuts on each of the support frames.

19. The reactor according to claim 1, wherein the variable spacer is disposed between the unit coils adjacent to each other in the central axis direction and between each of the support frames and the coil.

20. The reactor according to claim 2, wherein the variable spacer is disposed between the unit coils adjacent to each other in the central axis direction and between each of the support frames and the coil.

* * * * *